US010994819B2

(12) United States Patent
Tong et al.

(10) Patent No.: US 10,994,819 B2
(45) Date of Patent: May 4, 2021

(54) SNORKEL WITH SINGLE VALVE ASSEMBLY INCLUDING INTEGRATED DIAPHRAGM AND METHOD THEREOF

(71) Applicants: Kun Yuan Tong, Suwanee, GA (US); John Tong, Southlake, TX (US)

(72) Inventors: Kun Yuan Tong, Suwanee, GA (US); John Tong, Southlake, TX (US)

( * ) Notice: Subject to any disclaimer, the term of this patent is extended or adjusted under 35 U.S.C. 154(b) by 0 days.

(21) Appl. No.: 16/748,772

(22) Filed: Jan. 21, 2020

(65) Prior Publication Data

US 2020/0339238 A1 Oct. 29, 2020

Related U.S. Application Data

(62) Division of application No. 16/398,215, filed on Apr. 29, 2019, now Pat. No. 10,793,240.

(51) Int. Cl.
*B63C 11/20* (2006.01)

(52) U.S. Cl.
CPC ..... *B63C 11/205* (2013.01)

(58) Field of Classification Search
CPC ..... B63C 11/205; B63C 11/16
See application file for complete search history.

(56) References Cited

U.S. PATENT DOCUMENTS

| | | | | |
|---|---|---|---|---|
| 5,664,558 | A * | 9/1997 | Wagner | B63C 11/205 128/201.11 |
| 6,085,744 | A * | 7/2000 | Hermansen | B63C 11/205 128/201.11 |
| 6,302,102 | B1 * | 10/2001 | Giroux | B63C 11/205 128/201.11 |
| 7,717,108 | B2 * | 5/2010 | Ball | B63C 11/205 128/201.11 |
| 10,308,332 | B2 * | 6/2019 | Thomas | B63C 11/16 |
| 2011/0277755 | A1 * | 11/2011 | Amit | B63C 11/205 128/201.11 |

* cited by examiner

*Primary Examiner* — LaToya M Louis
(74) *Attorney, Agent, or Firm* — Guosheng Wang; United States Research and Patent Firm

(57) ABSTRACT

The present invention provides a snorkel having smaller respiratory dead space or volume. The snorkel includes a mouthpiece and a tube with an inhalation lumen and an exhalation lumen. A distal one-way inhalation valve is placed inside the inhalation lumen; and a distal one-way exhalation valve is placed inside the exhalation lumen. The invention also provides a method for reducing the volume of a respiratory dead space in a snorkel.

6 Claims, 14 Drawing Sheets

SNORKEL WITH SINGLE VALVE ASSEMBLY INCLUDING INTEGRATED DIAPHRAGM AND METHOD THEREOF

CROSS-REFERENCE TO RELATED APPLICATIONS

This application is a divisional application of U.S. application Ser. No. 16/398,215 filed Apr. 29, 2019, the entire content of which is incorporated herein by reference.

FIELD OF THE INVENTION

The present invention generally relates to a snorkel with small respiratory dead space and method thereof. Although the invention will be illustrated, explained and exemplified by using diaphragm check valves, it should be appreciated that the present invention can also be applied with other designs.

BACKGROUND OF THE INVENTION

As a popular recreational activity, particularly at tropical resort locations, snorkeling allows observation of marine life while swimming on the surface of the water. A snorkeler must therefore be able to hold the head under water while breathing, and he/she is typically equipped with a diving mask for viewing, fins, and a shaped tube called a snorkel for breathing. In cooler waters, a wetsuit may also be worn. The snorkel is a draw-type snorkel for use under water that includes means extending to the surface of the water to allow the user to draw air from the atmosphere with no means to supply respiratory gas under positive pressure as in scuba diving. A snorkel includes a tube and a mouthpiece which fits into the snorkeler's mouth. The mouthpiece is intended to be disposed below the water level, and the tube's inlet is intended to be disposed above the water level.

Ordinary snorkel has only one tube for inhalation and exhalation. When a snorkeler wears an ordinary snorkel, he/she always breathes in portion of exhaled $CO_2$ contaminated air and not the fresh air. Snorkelers wearing, the ordinary snorkel will acuminate a large amount of $CO_2$ in the blood after a long period of snorkeling in one section to lead to hypercapnia.

Hypercapnia can cause headache, lethargy, drowsiness, confusion and, if sever, can lead to coma and death. Hypercapnia may be the cause of death of several snorkelers in Hawaii every year.

Therefore, there exists a need to overcome the aforementioned problems. Advantageously, the present invention provides a snorkel with small respiratory dead space and method, thereof that allows the snorkeler always breaths in fresh air and prevents the acumination of $CO_2$ in the blood to cause hypercapnia.

SUMMARY OF THE INVENTION

One aspect of the present invention provides a snorkel 100 comprising (1) a mouthpiece or mask for a snorkeler to breathe air in and out; (2) a tube comprising an inhalation lumen and an exhalation lumen; (3) a distal one-way inhalation valve placed inside the inhalation lumen; and (4) a distal one-way exhalation valve placed inside the exhalation lumen. The tube has a distal end that is open to ambient air when the snorkeler is snorkeling and a proximal end that is connected to the mouthpiece or mask for air to inhale into the mouthpiece or mask from the inhalation lumen and to exhale from the mouthpiece or mask to the exhalation lumen 140.

Another aspect of the invention provides a method for reducing a volume of a respiratory dead space in a snorkel, comprising:

providing a mouthpiece or mask for a snorkeler to breathe air in and out;

providing a tube comprising an inhalation lumen and an exhalation lumen, wherein the tube has a distal end that is open to ambient air when the snorkeler is snorkeling and a proximal end that is connected to the mouthpiece or mask for air to inhale into the mouthpiece or mask from the inhalation lumen and to exhale from the mouthpiece or mask to the exhalation lumen;

placing a distal one-way inhalation valve inside the inhalation lumen;

placing a distal one-way exhalation valve inside the exhalation lumen; and placing a proximal one-way inhalation valve inside the inhalation lumen and between the distal one-way inhalation valve and the mouthpiece or mask, and/or a proximal one-way exhalation valve inside the exhalation lumen and between the distal one-way exhalation valve and the mouthpiece or mask.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form, omitted, or merely suggested, in order to avoid unnecessarily obscuring the present invention.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

It is also to be understood that the terminology used herein is for the purpose of describing particular embodiments only, and is not intended to limit the scope of the invention. For example, when an element is referred to as being "on", "connected to", or "coupled to" another element, it can be directly on, connected or coupled to the other element or intervening elements may be present. In contrast, when an element is referred to as being "directly on", "directly connected to", or "directly coupled to" another element, there are no intervening elements present.

Figure 1:
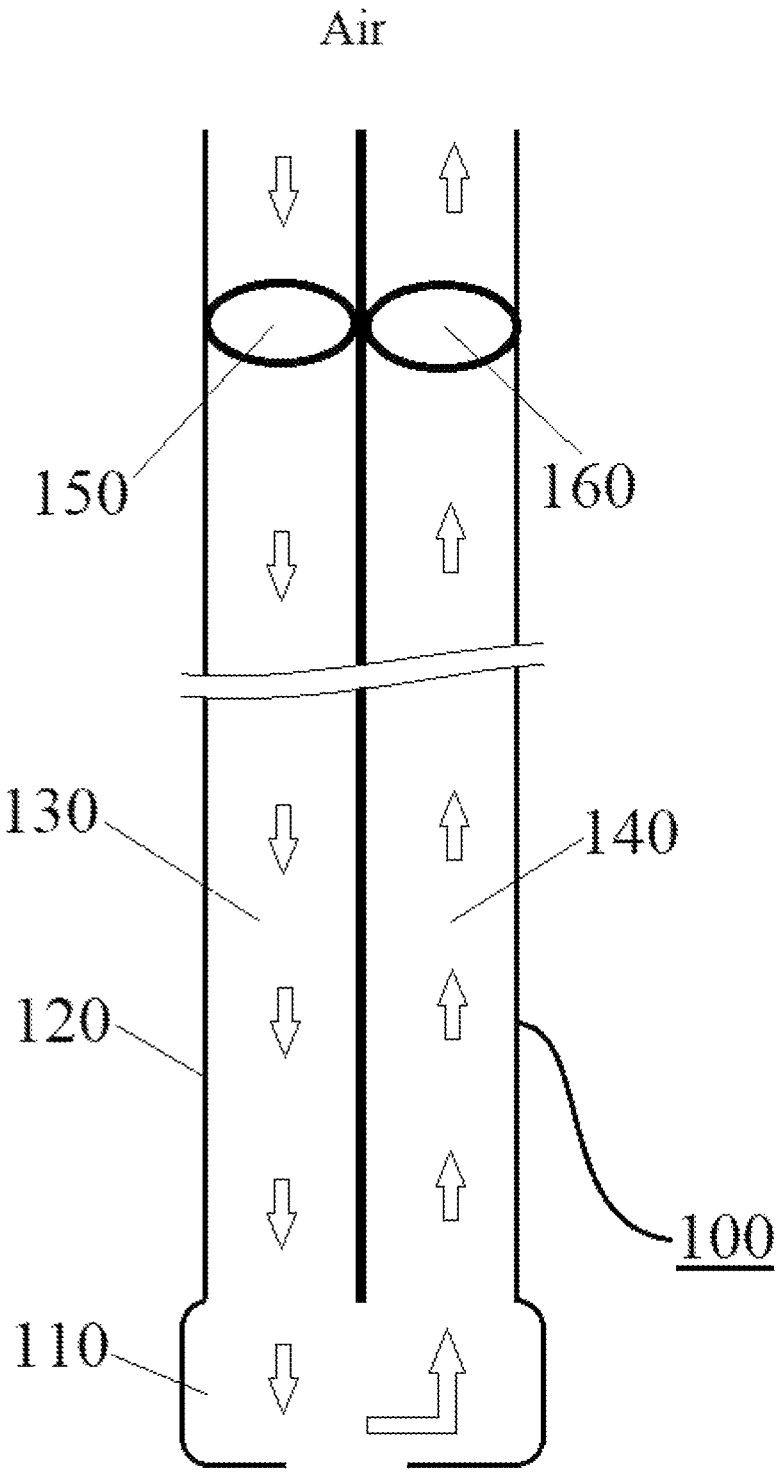
FIG. 1 schematically shows a basic design of snorkel in accordance with an exemplary embodiment of the present invention.

With reference to FIG. 1, a snorkel 100 includes a mouthpiece or mask 110 for a snorkeler to breathe air in and out. The mouthpiece may be made of natural rubber or silicone rubber. A tube 120 includes an inhalation lumen 130 and an exhalation lumen 140. The tube 120 has a distal end that is open to ambient air when the snorkeler is snorkeling and a proximal end that is connected to the mouthpiece or mask 110 for air to inhale into the mouthpiece or mask 110 from the inhalation lumen 130 and to exhale from the mouthpiece or mask 110 to the exhalation lumen 140. As such, the snorkel 100 may be used for breathing air from above the surface of water when the wearer's head is facing downwards in the water with the mouth and the nose submerged. In snorkel 100, a distal one-way inhalation valve 150 is placed inside the inhalation lumen 130; and a distal one-way exhalation valve 160 placed inside the exhalation lumen 140.

Figure 2:
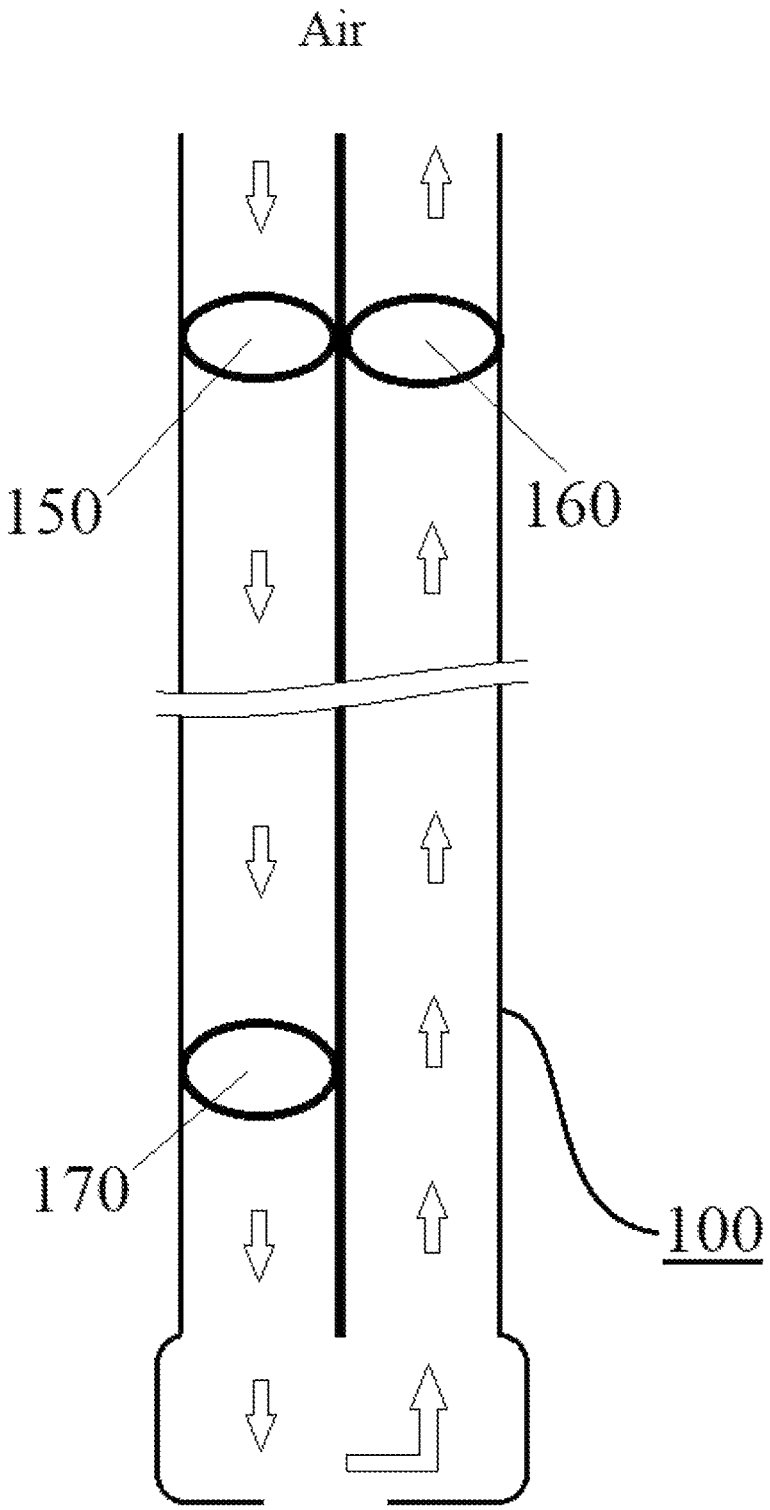
FIG. 2 schematically illustrates an improved design of snorkel in accordance with an exemplary embodiment of the present invention.
Figure 3:
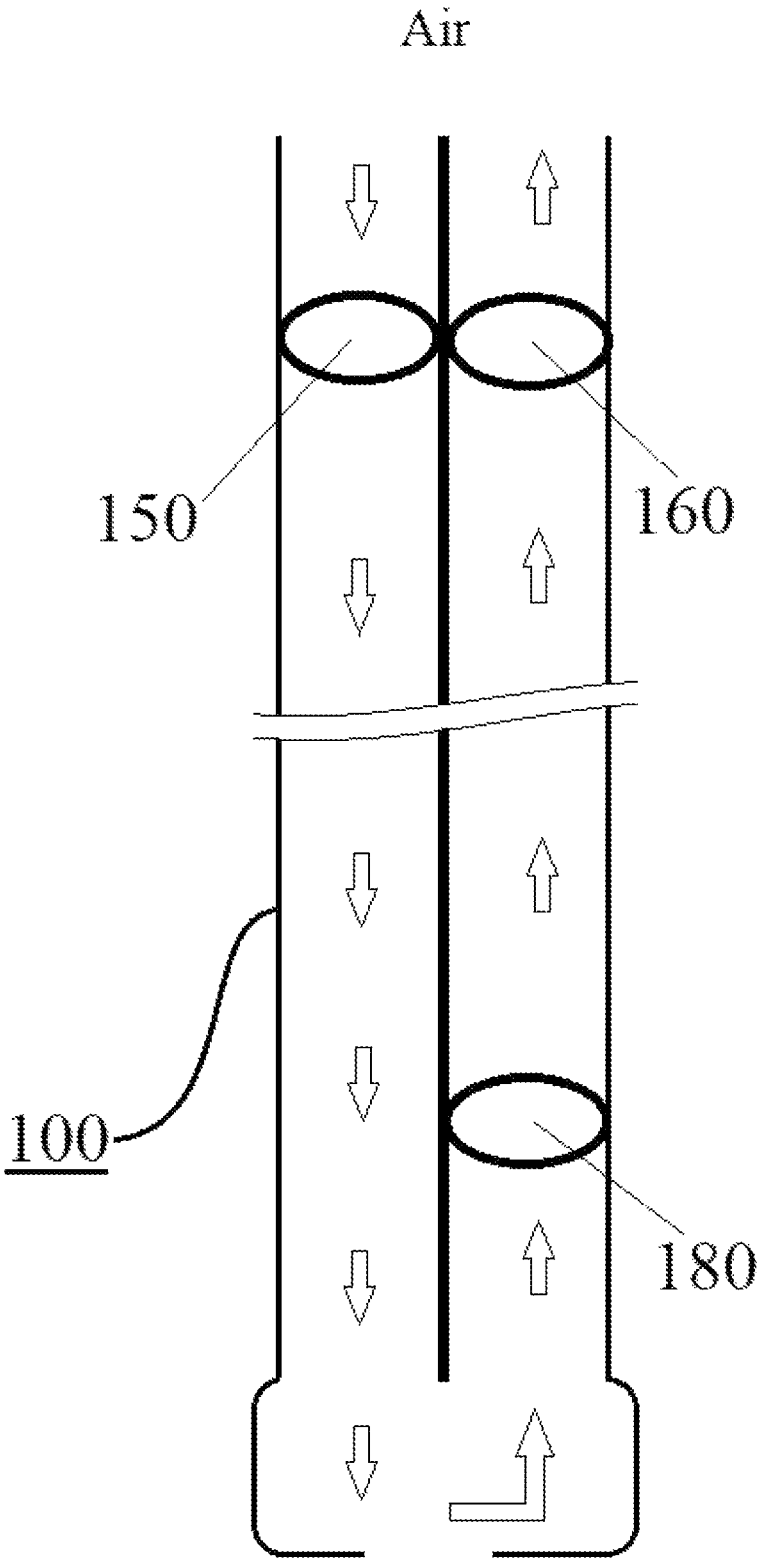
FIG. 3 schematically shows another improved design of snorkel in accordance with an exemplary embodiment of the present invention.

Snorkels will, more or less, constitute respiratory dead space or volume. When the user takes in a fresh breath, some of the previously exhaled air which remains in the snorkel is inhaled again, reducing the amount of fresh air in the inhaled volume, and increasing the risk of a buildup of carbon dioxide in the blood, which can result in hypercapnia. Because of valves 150/160, the respiratory dead space or volume is reduced. With reference to FIG. 2, the snorkel 100 may further comprise a proximal one-way inhalation valve 170. It may be placed inside the inhalation lumen 130 between the distal one-way inhalation valve 150 and the mouthpiece or mask 110, for further reducing the volume of respiratory dead space. With reference to FIG. 3, the snorkel 100 may further comprise a proximal one-way exhalation valve 180. It may be placed inside the exhalation lumen 140 between the distal one-way exhalation valve 160 and the mouthpiece or mask 110, for further reducing the volume of respiratory dead space.

Figure 4:
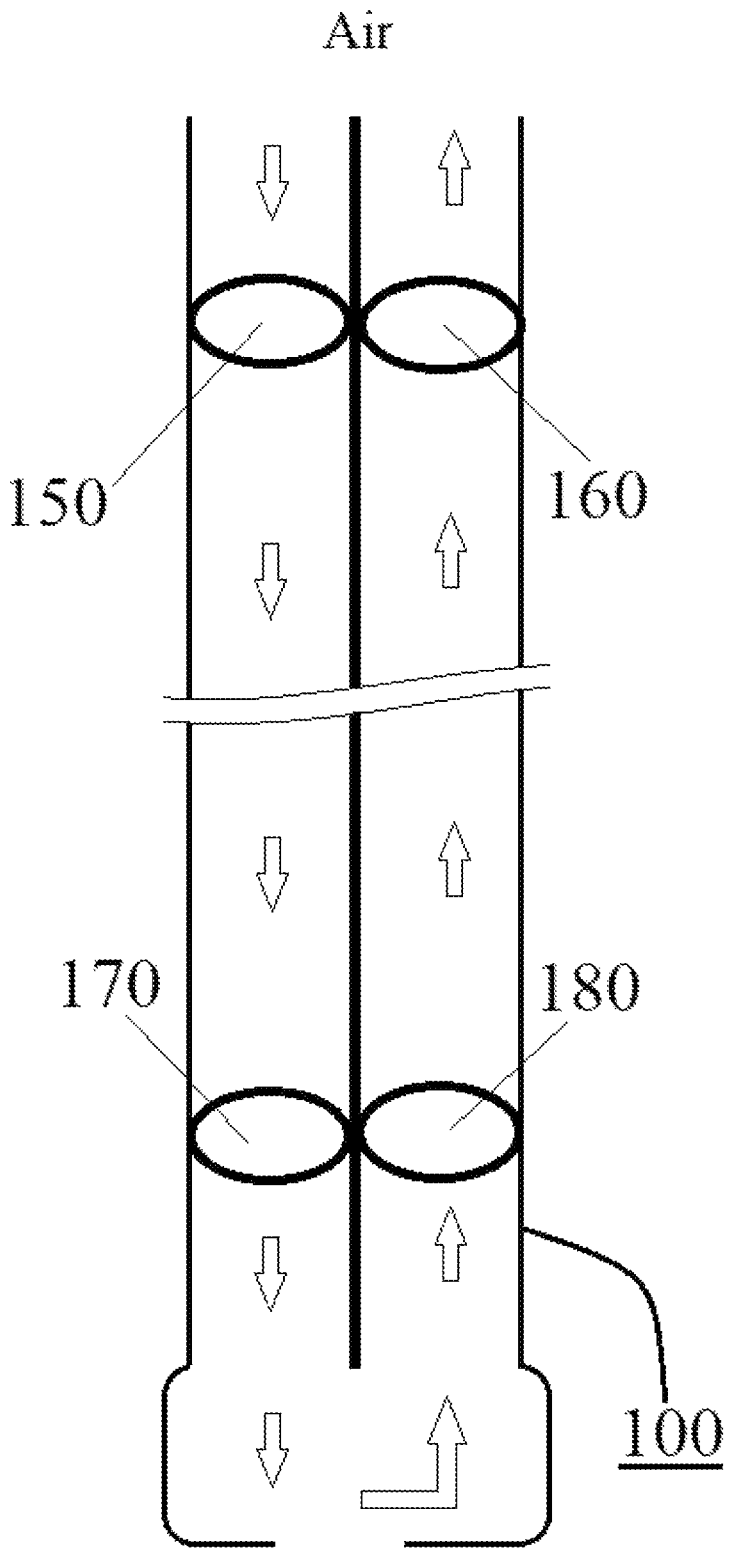
FIG. 4 schematically shows a preferred design of snorkel in accordance with an exemplary embodiment of the present invention.

With reference to FIG. 4, the snorkel 100 may further comprise both the proximal one-way inhalation valve 170 and the proximal one-way exhalation valve 180. This design can minimize the volume of respiratory dead space or volume.

Figure 5:
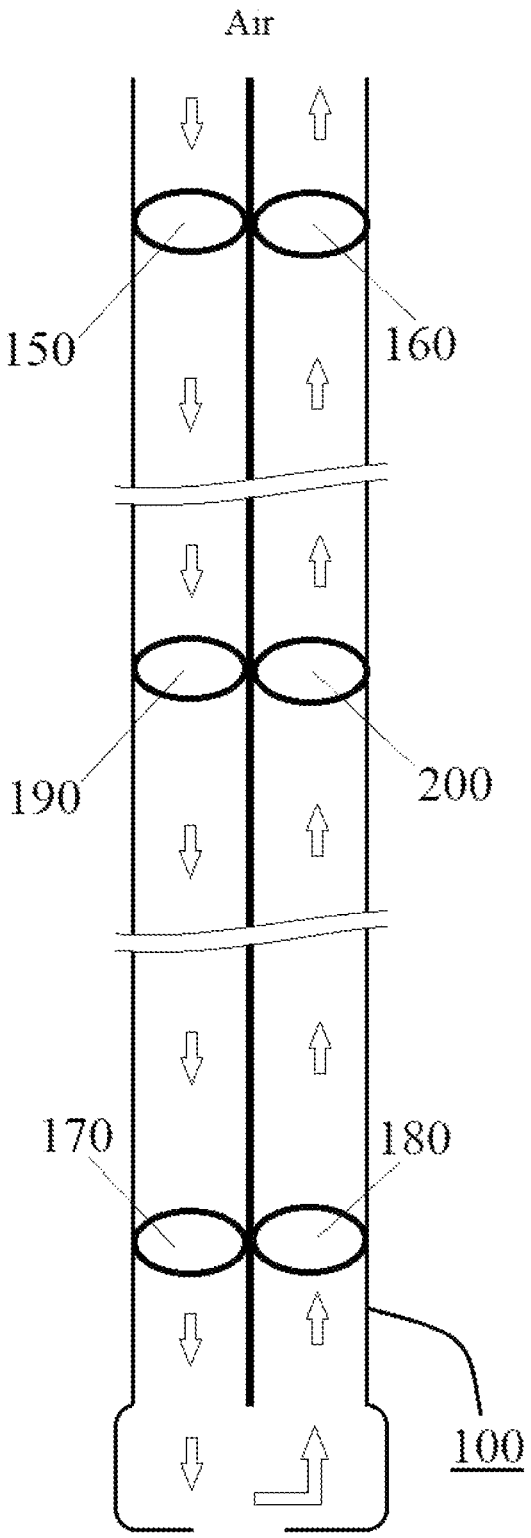
FIG. 5 schematically illustrates a snorkel with anti-collapse valves in accordance with an exemplary embodiment of the present invention.

With reference to FIG. 5, the snorkel 100 may further include one or more anti-collapse one-way inhalation valves 190. It or they may be placed inside the inhalation lumen 130 between the distal one-way inhalation valve 150 and the proximal one-way inhalation valve 170. Alternatively or in addition, the snorkel 100 may further comprise one or more anti-collapse one-way exhalation valves 200. It or they may be placed inside the exhalation lumen 140 between the distal one-way exhalation valve 160 and the proximal one-way exhalation valve 180. With anti-collapse one-way inhalation valves 190/200, the snorkel of the invention for users with larger lung capacities can exceed 38 centimeters in length and 230 cubic centimeters in internal volume. For users with smaller lung capacities, the snorkel of the invention can exceed 35 centimeters in length and 150 cubic centimeters in internal volume. In some embodiments, the snorkels of the invention can have a total length greater than 48 cm and to have an inner lumen diameter greater than 2.3 cm.

In a preferred embodiment, each of the above one-way valves (e g. 150, 160, 170, 180, 190 and/or 200) is a diaphragm check valve. A diaphragm check valve uses a flexing rubber diaphragm positioned to create a normally-closed valve. Pressure on the upstream side must be greater than the pressure on the downstream side by a certain amount, known as the pressure differential, for the check valve to open allowing flow. Once positive pressure stops, the diaphragm automatically flexes back to its original closed position.

However, it should appreciated that theses one-way valves may be any other suitable check valve, clack valve, non-return valve, reflux valve, or retention valve as long as it allows air to flow through it in only one direction. In various embodiments, each of the above one-way valves (e.g. 150, 160, 170, 180, 190 and/or 200) may be a ball check valve (either spring-loaded or not), or a similar check valve where the disc is not a ball, but some other shape, such as a poppet energized by a spring. It may be a swing check valve or tilting disc check valve in which the disc, the movable part to block the flow, swings on a hinge or trunnion, either onto the seat to block reverse flow or off the seat to allow forward flow. It may also be a flapper valve, a clapper valve, a backwater valve, a stop-check valve, a lift-check valve, an in-line check valve, a duckbill valve, and the like.

Figure 6A:
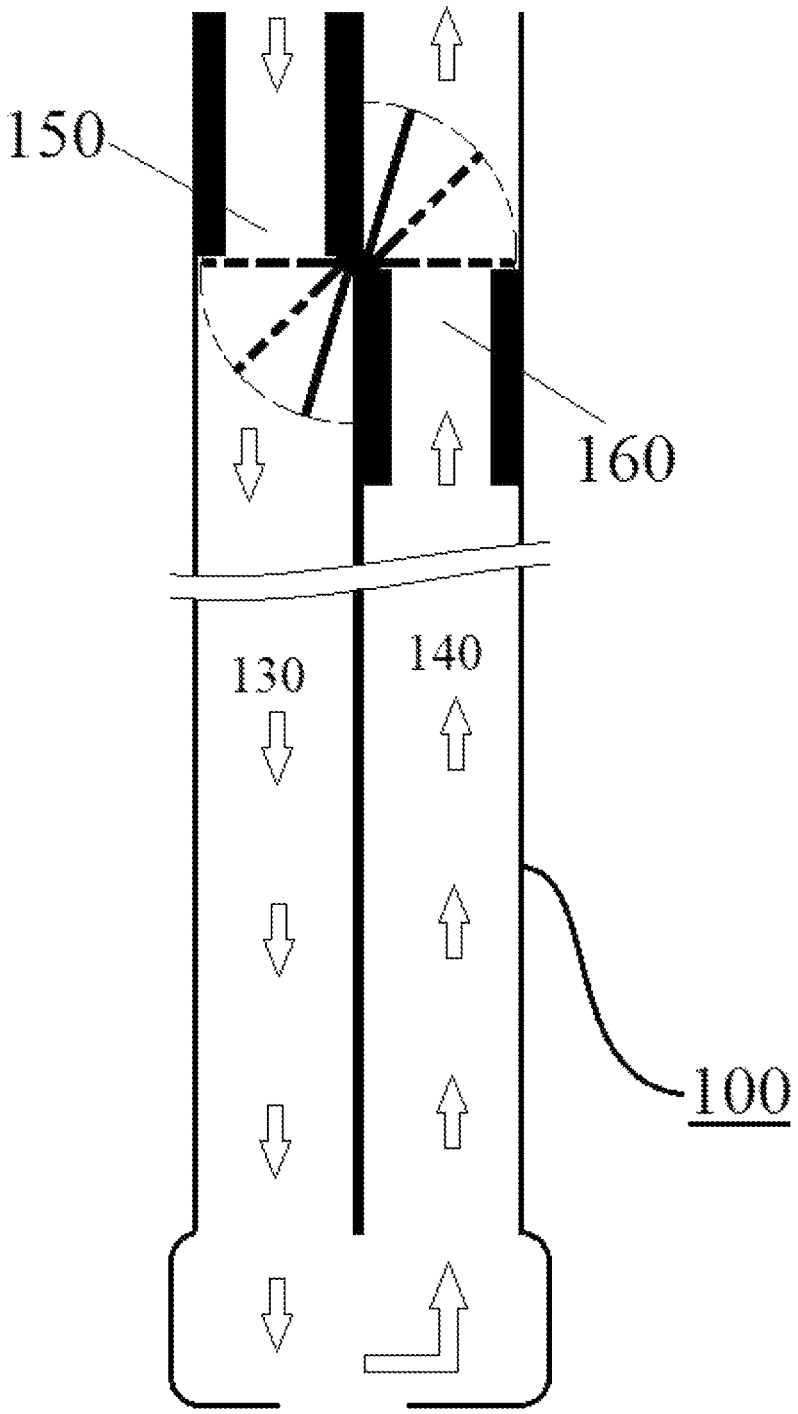
FIG. 6A and FIG. 6B schematically illustrate a snorkel with paired valves that are built as a single valve assembly in accordance with an exemplary embodiment of the present invention.
Figure 6B:
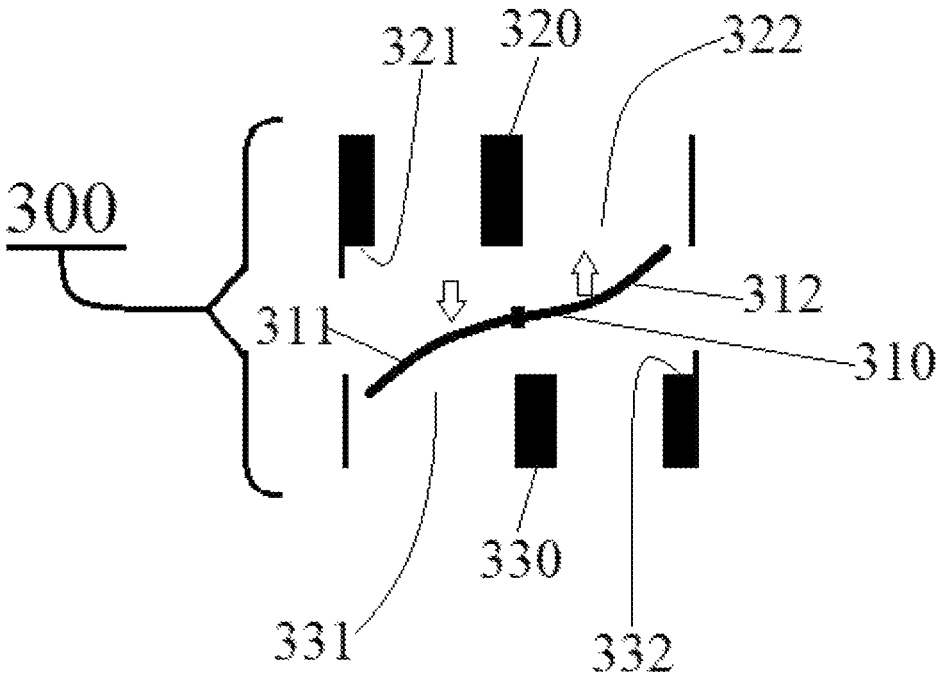

In various embodiments, the distal one-way inhalation valve 150 and the distal one-way exhalation valve 160 as shown in FIG. 6A are paired together and built as a single valve assembly 300, as shown in FIG. 6B. The single valve assembly 300 may comprise (1) an integrated diaphragm 310 including an inhalation diaphragm portion 311 and an exhalation diaphragm portion 312; (2) a distal member 320 including a seat 321 for the inhalation diaphragm portion 311 to sit on so as to seal the inhalation lumen 130, and a gate 322 for receiving, the exhalation diaphragm portion 312 so as to open the exhalation lumen 140, and (3) a proximal member 330 including a gate 331 for receiving the inhalation diaphragm portion 311 so as to open the inhalation lumen 130, and a seat 332 for the exhalation diaphragm portion 312 to sit on so as to seal the exhalation lumen 140. In typical embodiments, the integrated diaphragm 310, the distal member 320 and the proximal member 330 are secured together into one functional part, either inside lumens 130/140 or extending from lumens 130/140 and capable of communicate air thereto and therefrom.

In a similar manner, the proximal one-way inhalation valve 170 and the proximal one-way exhalation valve 180 can be built as a single valve assembly (not shown). Similarly, the assembly includes (1) an integrated diaphragm including an inhalation diaphragm portion and an exhalation diaphragm portion, (2) a distal member including a seat for the inhalation diaphragm portion to sit on so as to seal the inhalation lumen, and a gate for receiving the exhalation diaphragm portion so as to open the exhalation lumen; and (3) a proximal member including a gate for receiving the inhalation diaphragm portion so as to open the inhalation lumen, and a seat for the exhalation diaphragm portion to sit on so as to seal the exhalation lumen. In typical embodiments, the integrated diaphragm, the distal member and the proximal member are also secured together into one functional part, either inside lumens 130/140 or extending from lumens 130/140 and capable of communicate air thereto and therefrom.

In a similar manner, the anti-collapse one-way inhalation valve 190 and the anti-collapse one-way exhalation valve 200 can also be built as a single valve assembly (not shown). Similarly, the assembly includes (1) an integrated diaphragm including an inhalation diaphragm portion and an exhalation diaphragm portion; (2) a distal member including a seat for the inhalation diaphragm portion to sit on so as to seal the inhalation lumen, and a gate for receiving the exhalation diaphragm portion so as to open the exhalation lumen; and (3) a proximal member including a gate for receiving the inhalation diaphragm portion so as to open the inhalation lumen, and a seat for the exhalation diaphragm portion to sit on so as to seal the exhalation lumen. In typical embodiments, the integrated diaphragm, the distal member and the proximal member are secured together into one functional part inside lumens 130/140.

Figure 7:
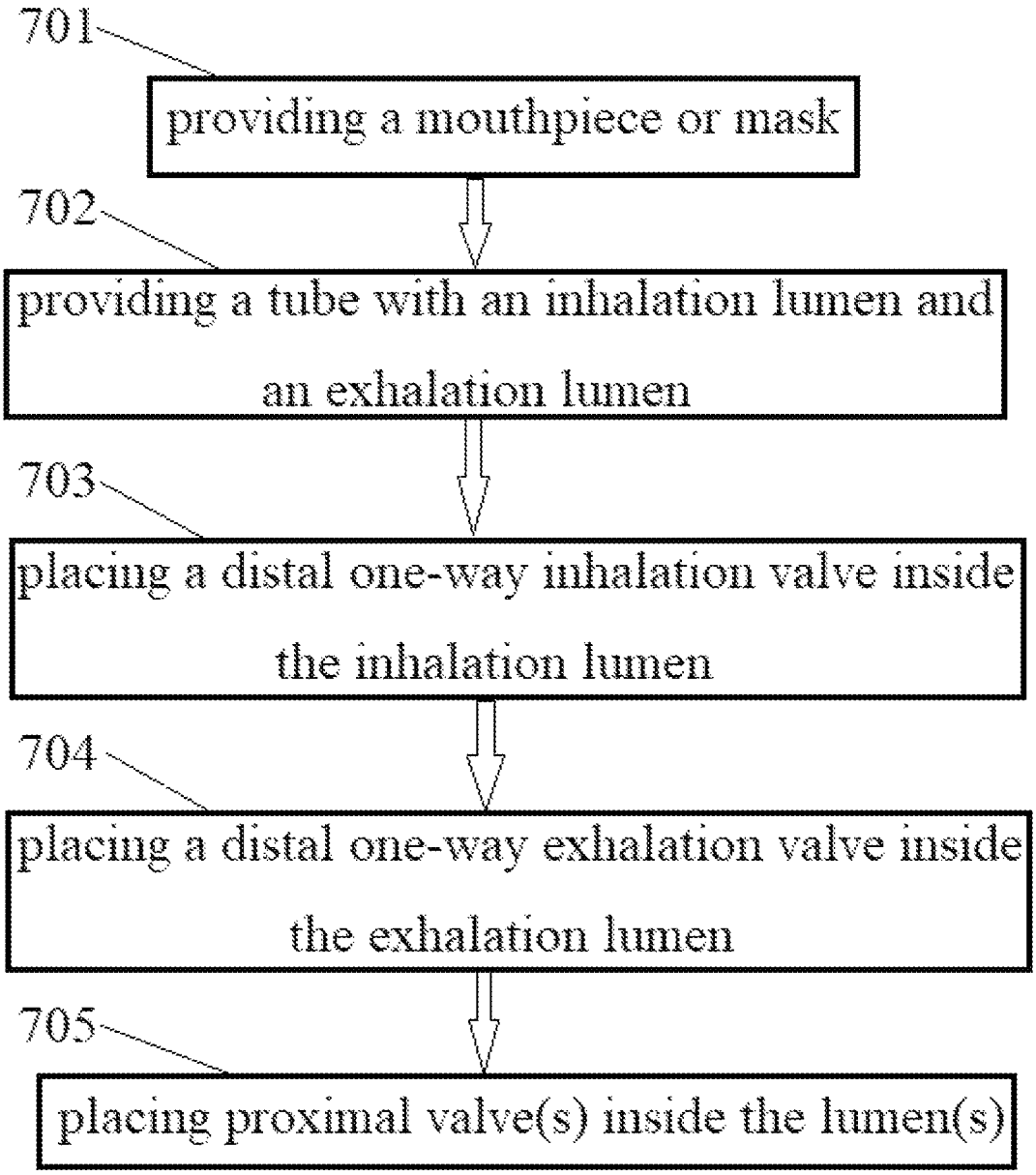
FIG. 7 is the flow chart of a method for reducing a volume of a respiratory dead space in a snorkel in accordance with an exemplary embodiment of the present invention.

In various embodiments, the present invention provides a method for reducing a volume of a respiratory dead space in a snorkel. As shown in FIG. 7, the method includes:

step 701 of providing a mouthpiece or mask 110 for a snorkeler to breathe air in and out;

step 702 of providing a tube 120 comprising an inhalation lumen 130 and an exhalation lumen 140, wherein the tube 120 has a distal end that is open to ambient air when the snorkeler is snorkeling and a proximal end that is connected to the mouthpiece or mask 110 for air to inhale into the mouthpiece or mask 110 from the inhalation lumen 130 and to exhale from the mouthpiece or mask 110 to the exhalation lumen 140;

step 703 of placing a distal one-way inhalation valve 150 inside the inhalation lumen 130;

step 704 of placing a distal one-way exhalation valve 160 inside the exhalation lumen 140, and step 705 of placing a proximal one-way inhalation valve 170 inside the inhalation lumen 130 and between the distal one-way inhalation valve 150 and the mouthpiece or mask 110, and/or a proximal one-way exhalation valve 180 inside the exhalation lumen 140 and between the distal one-way exhalation valve 160 and the mouthpiece or mask 110.

Figure 8:
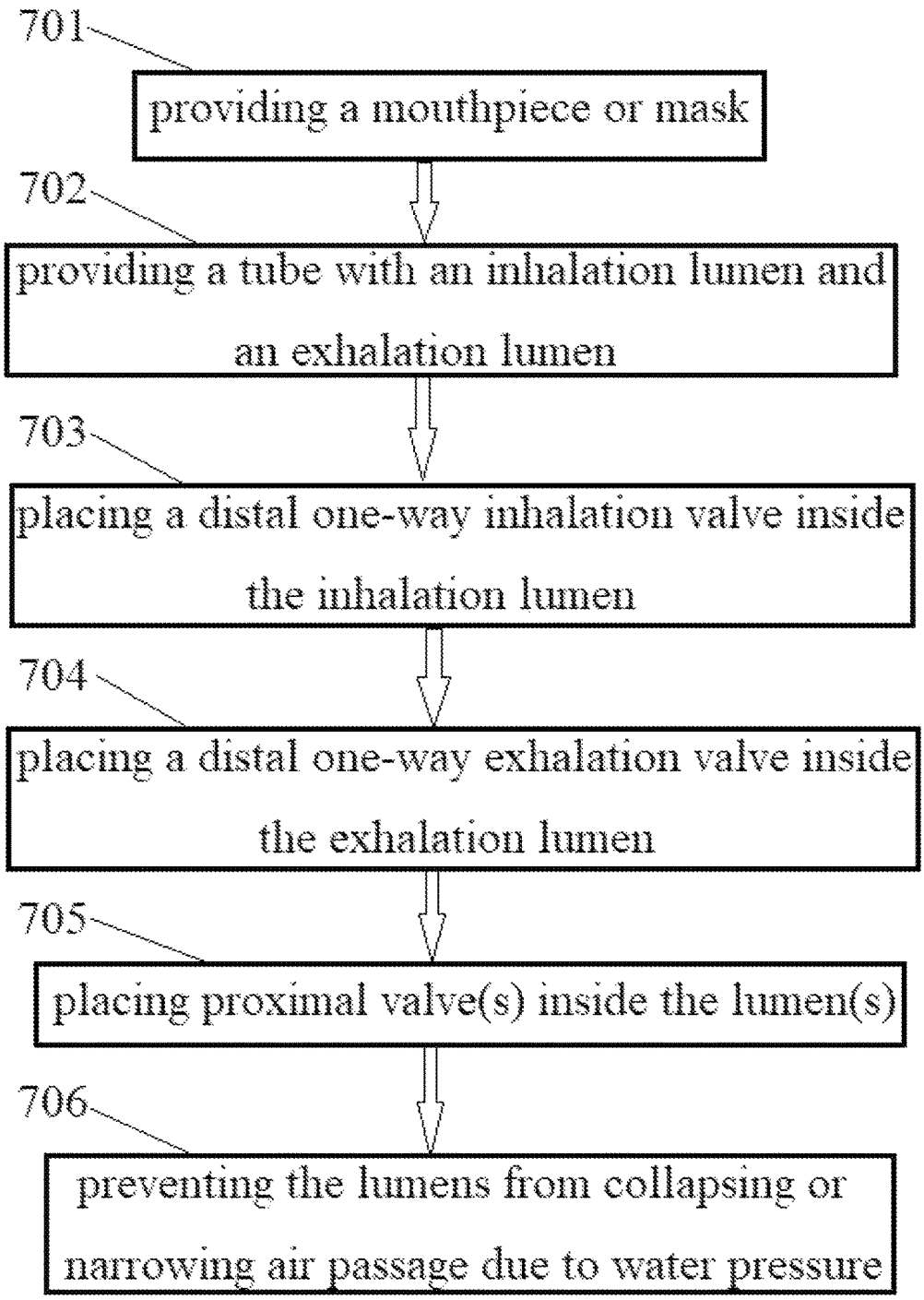
FIG. 8 is the flow chart of an improved method in accordance with an exemplary embodiment of the present invention.

As shown in FIG. 8, the method of the invention may further include:

step 706 of preventing the inhalation lumen 130 and/or the exhalation lumen 140 from collapsing or narrowing air passage due to water pressure against tube 120 in snorkeling, for example, placing one or more anti-collapse one-way inhalation valves 190 inside the inhalation lumen 130 and between the distal one-way inhalation valve 150 and the proximal one-way inhalation valve 170, and/or one or more anti-collapse one-way exhalation valves 200 inside the exhalation lumen 140 and between the distal one-way exhalation valve 160 and the proximal one-way exhalation valve 180.

The snorkel of the invention may be either separate or integrated into a swimming or diving mask. The integrated version is only suitable for surface snorkeling, while the separate device may also be used for underwater activities such as spearfishing, freediving, fin-swimming, underwater hockey, and underwater rugby; and for surface breathing with scuba equipment.

The snorkel of the invention may be bent into a shape often resembling the letter "L" or "J", fitted with a mouthpiece at the lower end and constructed of light metal, rubber or plastic. The snorkel of the invention may come with a rubber loop or a plastic clip enabling the snorkel to be attached to the outside of the head strap of the diving mask. The snorkel may also be secured by tucking the tube between the mask-strap and the head.

Figure 9:
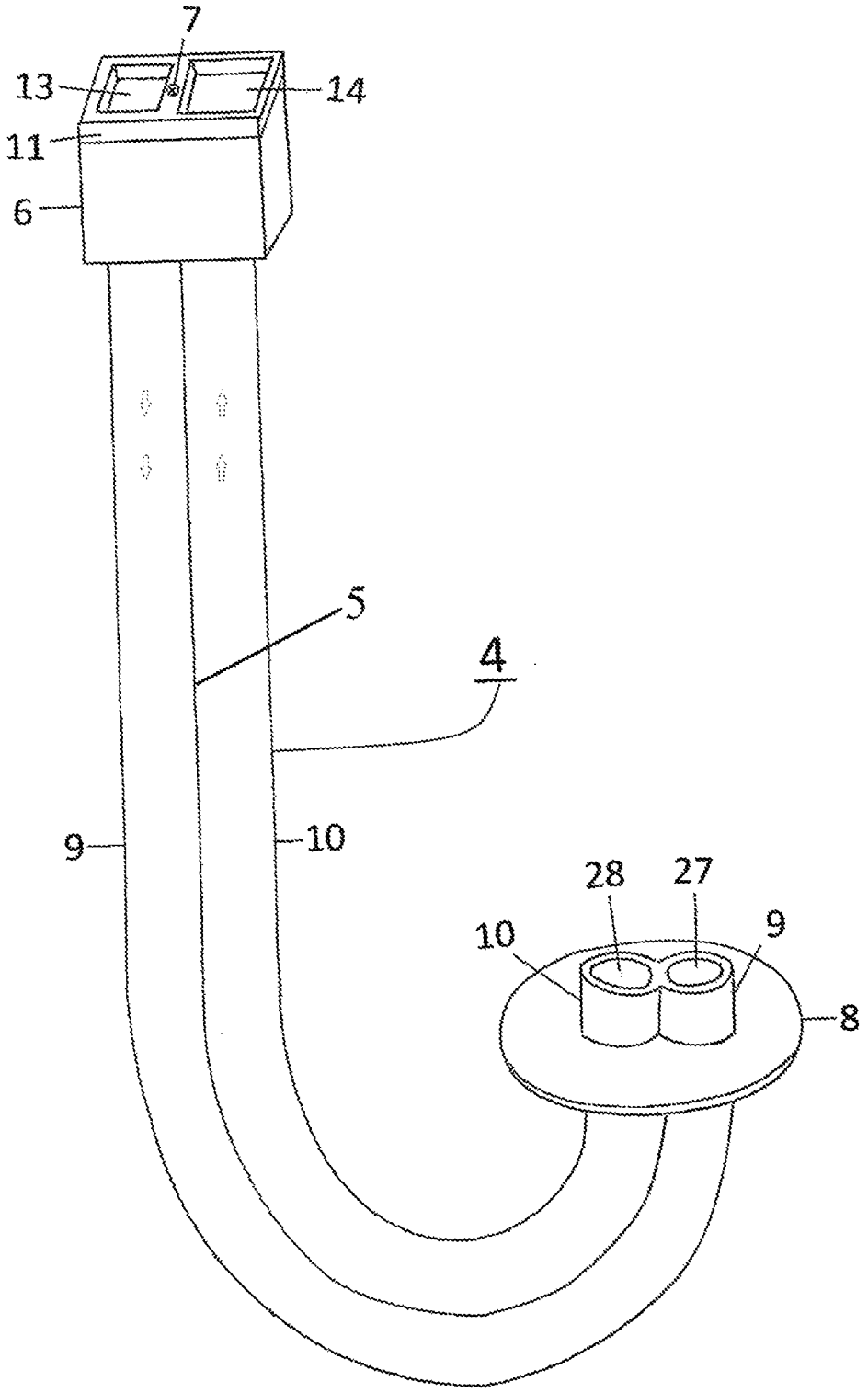
FIG. 9 schematically shows a specific design of snorkel in accordance with an exemplary embodiment of the present invention.
Figure 10:
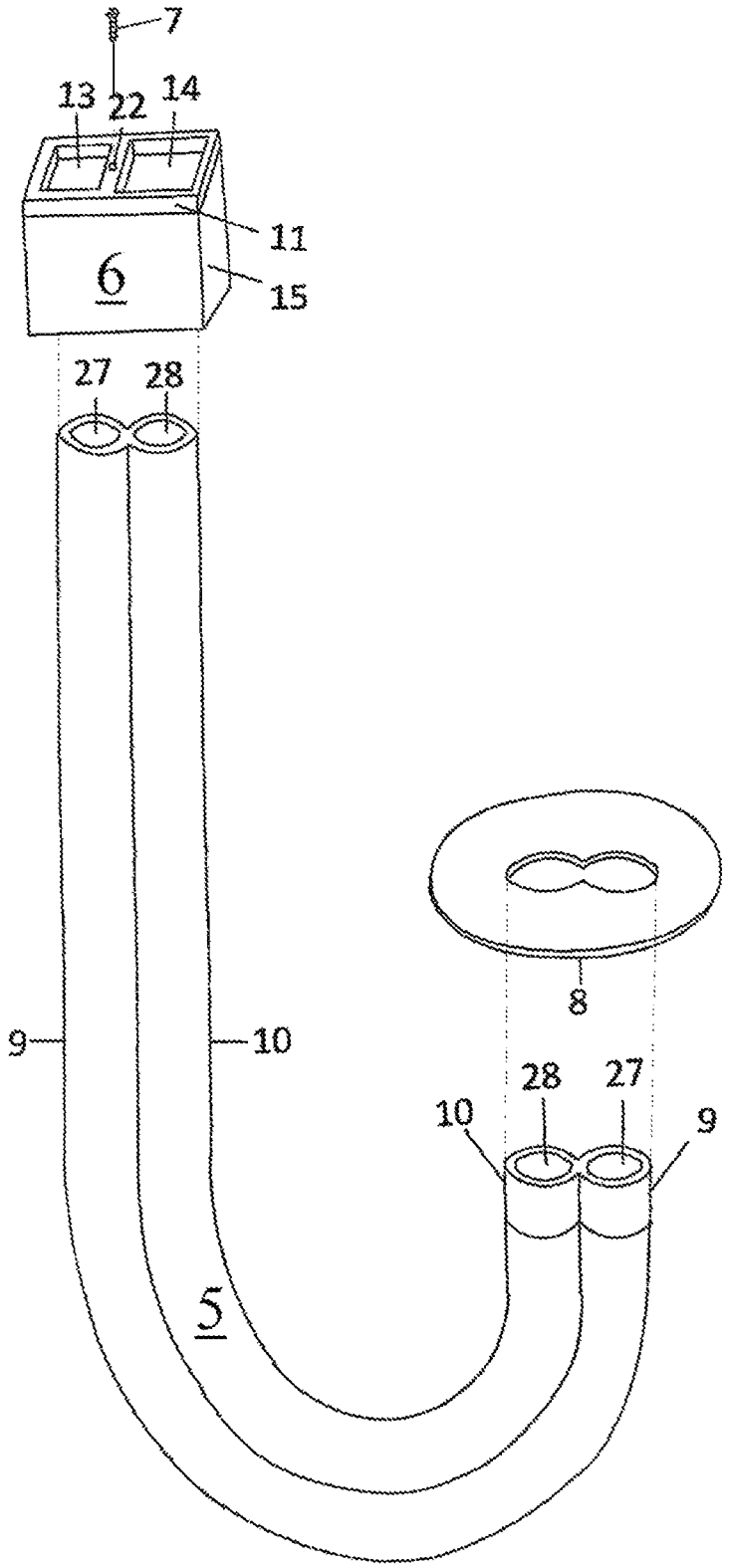
FIG. 10 schematically illustrates a specific design of snorkel in accordance with an exemplary embodiment of the present invention.
Figure 11A:
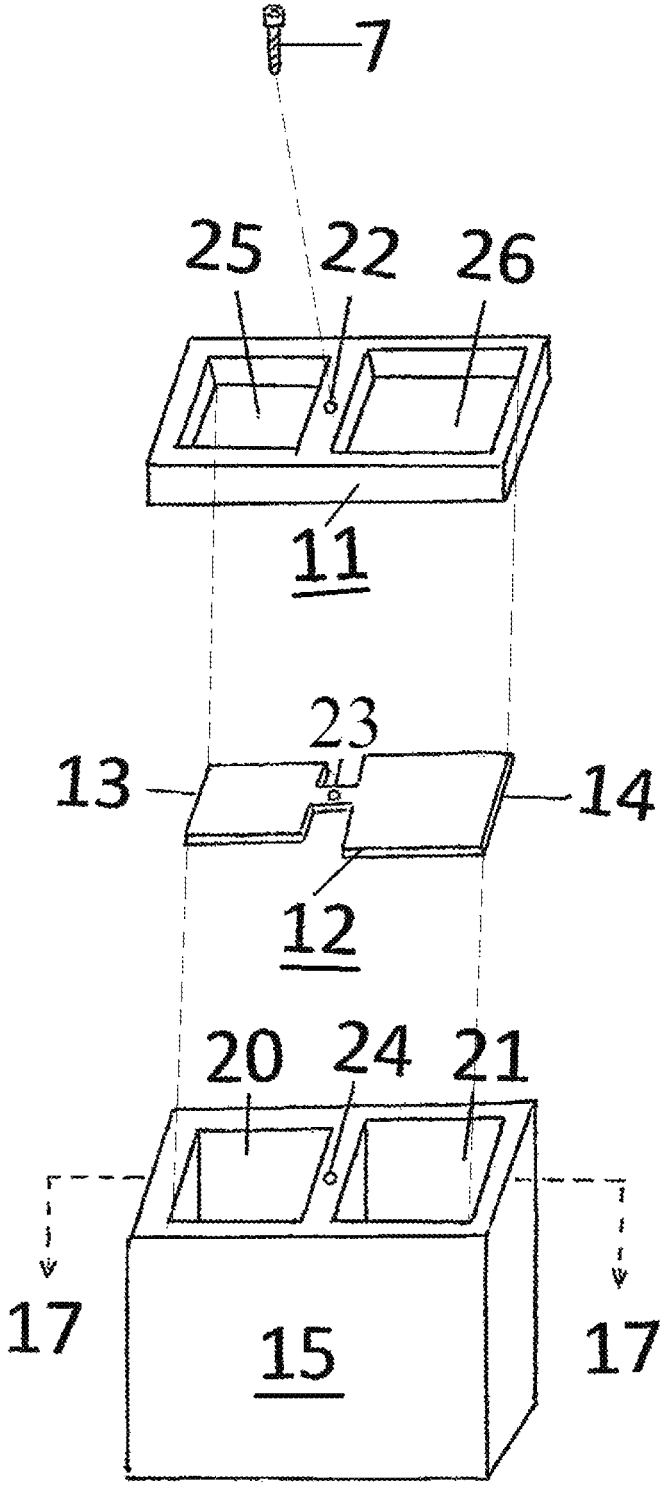
FIG. 11A, FIG. 11B and FIG. 11C schematically illustrate a specific design of snorkel in accordance with an exemplary embodiment of the present invention.

In a specific embodiment as shown in FIGS. 9, 10 and 11A, a snorkel 4 is equipped with a two-lumen breathing tube 5 and a valve unit 6 (an embodiment of the above single valve assembly 300). Snorkel 4 includes mouth wing 8, an inhalation breathing tube 9 with canal 27, and an exhalation breathing tube 10 with canal 28. Valve unit 6 includes top cover 11 (an embodiment of the above distal member 320), integrated diaphragm 12 (which can be of any shape, e.g. butterfly-shaped), and proximal member 15.

Top cover 11 has two windows (25, 26) that one (26) is larger than the other (25) and a central bridge which has one screw hole 22 at the center. Integrated diaphragm 12 includes inhalation diaphragm portion 13 and exhalation diaphragm portion 14, and a screw hole 23 in between. Integrated diaphragm 12 may be butterfly shaped and comprise one larger wing 14, one smaller wing 13, and has a central screw hole 23 at the center. The smaller wing 13 of butterfly-shaped valve is smaller than the smaller window 25 of top cover 11, and larger wing 14 is smaller than the larger window 26 of top cover 11.

Figure 11B:
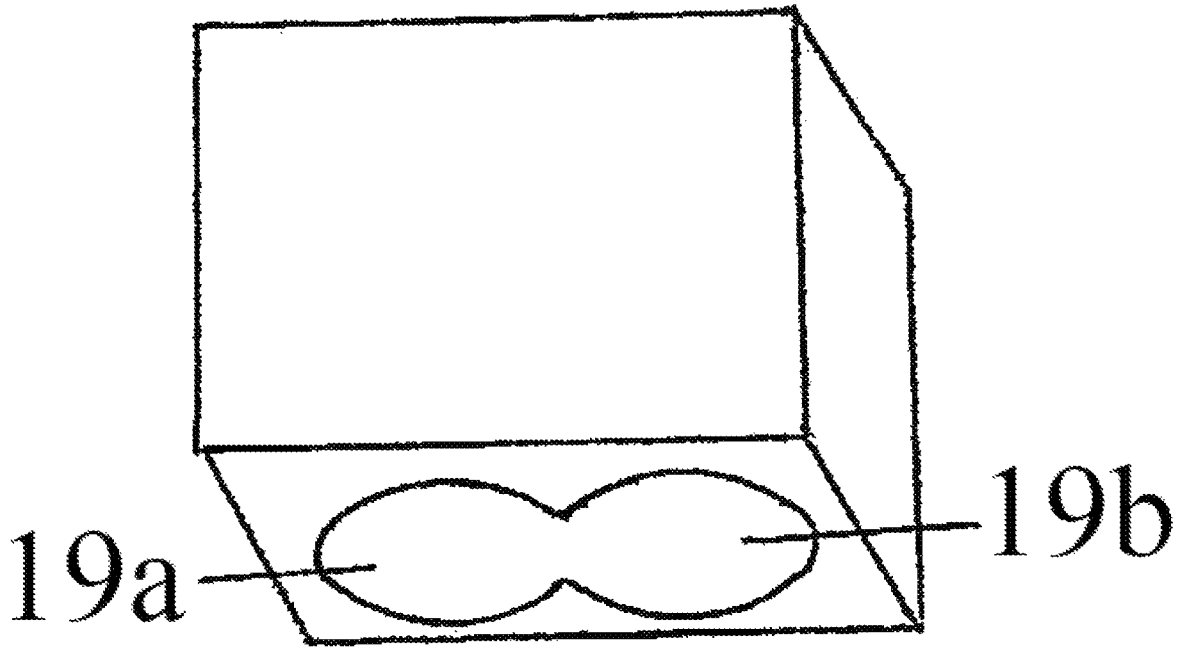
Figure 11C:
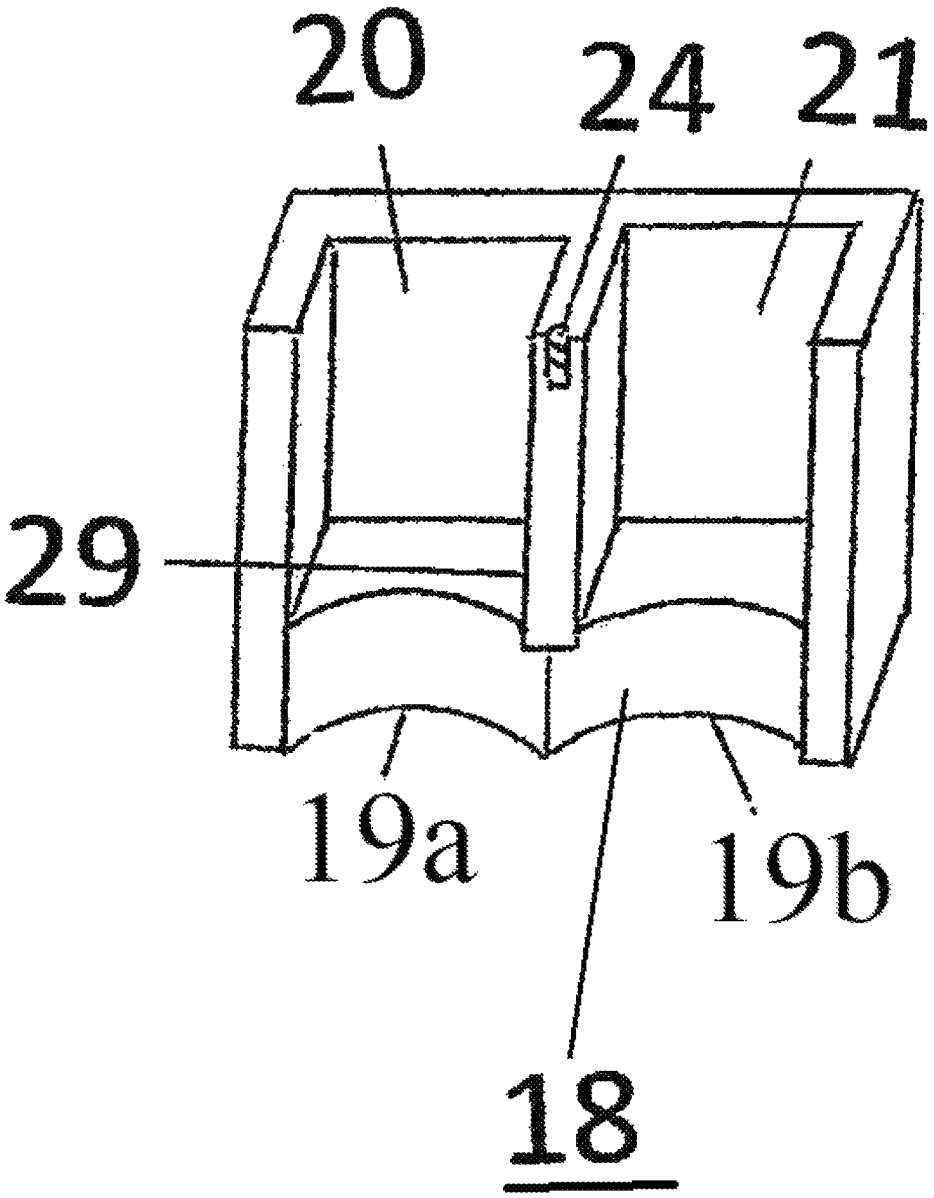

Proximal member 15 of valve unit 6 may have a bottom view as shown in FIG. 11B. A sectional view of proximal member 15 through dissection line 17 through the middle of proximal member 15 is also shown in FIG. 11C. Admitting hole 19*a* of proximal member 15 can admit snugly breathing tube 9, and another admitting hole 19*b* of proximal member 15 can admit snugly breathing tube 10. Inhalation chamber 20 communicates with admitting hole 19*a*, and exhalation chamber 21 communicates with admitting, hole 19*b*.

Screw hole 22 of top cover 11 allows screw 7 to pass easily, and screw hole 23 of integrated diaphragm 12 also allows screw 7 to pass through easily. Screw 7 can pass easily through screw hole 22 and screw hole 23 to screw into threaded cannel 24 to fix top cover 11 and integrated diaphragm 12 onto body of proximal member 15 to make valve unit 6.

Window of inhalation 25 is smaller than inhalation diaphragm portion 13. Inhalation diaphragm portion 13 is smaller than inhalation chamber 20. Therefore, inhalation diaphragm portion 13 can only bent downward by flush of inhalation breath of the snorkeler. Exhalation chamber 21 is smaller than exhalation diaphragm portion 14. Exhalation diaphragm portion 14 is smaller than window of exhalation 26. Therefore, exhalation diaphragm portion 14 can only be bent outward by flush of exhalation of the snorkeler. Therefore, valve unit 6 provides one-way breathing cycle.

Partition wall 29 divides proximal member 15 into two chambers, i.e. chamber 20 and chamber 21. Partition 29 can stop tube 5 and can prevent it from moving upward. When admitting hole 19*a* is connected to breathing tube 9 and admitting hole 19*b* is connected to breathing tube 10, tube 5 provides one-way breathing cycle to allow fresh air to be breathed in through window of inhalation 25 to pass through canal 27 into snorkeler's lung and the $CO_2$ polluted air exhaled through canal 28 and window of exhalation 26 into air. Therefore snorkeler who wears tube 5 always inhales fresh air to prevent hypercapnia.

As shown in FIGS. 9 and 10, the J-shaped tube connects valve unit 6 at its top and has a mouth biting piece built at the up-turning shaped lower end. The mouth-biting piece may include an oval-shaped wing 8 and a terminal portion of tubes 9 and 10 at their proximal end.

Proximal member 15 comprises two equal chambers (20, 21), one at the right side and the other at the left side, divided by a central partition 29. One central threaded canal 24 is located at the middle of the central partition 29. One figure of eight bottom hole of proximal member 15 can admit the top of two channels breathing tube (9, 10). Chamber 20/21 is larger than the smaller wing 13 but smaller than larger wing 14. Therefore, smaller wing 13 can only bent inward into the chamber 20 and larger wing 14 can only be bent outward. Screw 7 can pass through central screw hole 22 of the top cover 11 and the central screw hole 23 of butterfly-shaped integrated diaphragm 12, and then screw into the threaded canal 24 of central partition 29 to fix or secure top cover 11 and butterfly-shaped integrated diaphragm 12 onto proximal member 15.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A snorkel (100) comprising:

a mouthpiece or mask (110) for a snorkeler to breathe air in and out;

a tube (120) comprising an inhalation lumen (130) and an exhalation lumen (140), wherein the tube (120) has a distal end that is open to ambient air when the snorkeler is snorkeling and a proximal end that is connected to the mouthpiece or mask (110) for air to inhale into the mouthpiece or mask (110) from the inhalation lumen (130) and to exhale from the mouthpiece or mask (110) to the exhalation lumen (140);

a distal one-way inhalation valve (150) placed inside the inhalation lumen (130); and a distal one-way exhalation valve (160) placed inside the exhalation lumen (140);

wherein each of the one-way valves is a diaphragm check valve;

wherein the distal one-way inhalation valve (150) and the distal one-way exhalation valve (160) are built as a single valve assembly (300);

wherein the single valve assembly (300) is a valve unit (6) including a top cover (11), an integrated diaphragm (12), and a proximal member (15);

wherein the top cover (11) has two windows (25, 26) that one (26) is larger than the other (25) and a central bridge which has one screw hole (22) at a center;

wherein the integrated diaphragm (12) includes an inhalation diaphragm portion (13) and an exhalation diaphragm portion (14), and a screw hole (23) in between the inhalation diaphragm portion and the exhalation diaphragm portion;

wherein the integrated diaphragm (12) is butterfly shaped and comprises one larger wing (14), one smaller wing (13), and the screw hole (23) at the center; and wherein the smaller wing (13) is smaller than the smaller window (25) of top cover (11), and the larger wing (14) is smaller than the larger window (26) of the top cover (11); and wherein the snorkel is constructed of light metal, rubber or plastic.

2. The snorkel according to claim 1, further comprising a proximal one-way inhalation valve (170) that is placed inside the inhalation lumen (130) and that is between the distal one-way inhalation valve (150) and the mouthpiece or mask (110), for reducing a volume of a respiratory dead space.

3. The snorkel according to claim 1, further comprising a proximal one-way exhalation valve (180) that is placed inside the exhalation lumen (140) and that is between the distal one-way exhalation valve (160) and the mouthpiece or mask (110), for reducing a volume of a respiratory dead space.

4. The snorkel according to claim 1, further comprising:

a proximal one-way inhalation valve (170) that is placed inside the inhalation lumen (130) and that is between the distal one-way inhalation valve (150) and the mouthpiece or mask (110); and a proximal one-way exhalation valve (180) that is placed inside the exhalation lumen (140) and that is between the distal one-way exhalation valve (160) and the mouthpiece or mask (110), for minimizing a volume of a respiratory dead space.

5. The snorkel according to claim 4, further comprising:

one or more anti-collapse one-way inhalation valves (190) that are placed inside the inhalation lumen (130) and between the distal one-way inhalation valve (150) and the proximal one-way inhalation valve (170); and one or more anti-collapse one-way exhalation valves (200) that are placed inside the exhalation lumen (140) and between the distal one-way exhalation valve (160) and the proximal one-way exhalation valve (180).

6. The snorkel according to claim 1, wherein the proximal member (15) of valve unit (6) includes an inhalation chamber (20) that communicates with a first admitting hole (19*a*), and an exhalation chamber (21) that communicates with a second admitting hole (19*b*); and wherein the first admitting hole (19*a*) admits a tube (9), and the second admitting hole (19*b*) admits a breathing tube (10).

* * * * *